United States Patent [19]

Montgoris et al.

[11] 3,994,057

[45] Nov. 30, 1976

[54] IMPACT TOOL FOR INSTALLING DORMERS

[75] Inventors: Frank Montgoris; Rudolph Powers, both of Levittown, N.Y.

[73] Assignee: Lawrence Peska Associates, Inc., New York, N.Y. ; a part interest

[22] Filed: Apr. 4, 1975

[21] Appl. No.: 565,232

[52] U.S. Cl. ..... 29/254; 81/52.35; 173/131

[51] Int. Cl.[2] ..... B23P 19/04

[58] Field of Search..... 29/254; 145/29 R, 29 A, 145/29 B, 29 C; 173/131, 126, 121, 132; 81/3 R, 52.35, 177 R, 177 A

[56] References Cited

UNITED STATES PATENTS

| | | | |
|---|---|---|---|
| 1,958,329 | 8/1934 | Beard | 29/254 |
| 2,099,246 | 11/1937 | Raffles | 173/131 X |
| 2,177,232 | 10/1939 | Tinnerman | 29/278 X |

FOREIGN PATENTS OR APPLICATIONS

| | | | |
|---|---|---|---|
| 59,996 | 10/1938 | Norway | 145/29 B |

*Primary Examiner*—James L. Jones, Jr.

[57] ABSTRACT

An impact tool is used to apply an impact blow to the underside of a portion of a roof which has been partly cut away, wherein the portion of the roof is removed for the installation of a dormer. The impact tool consists of an elongated hollow handle formed from a plurality of sections, wherein the sections permit length adjustment of the handle. A heavy weight element communicates with an upper free end of a top section and a rubber cushion element communicates with a bottom end of a bottom section.

1 Claim, 4 Drawing Figures

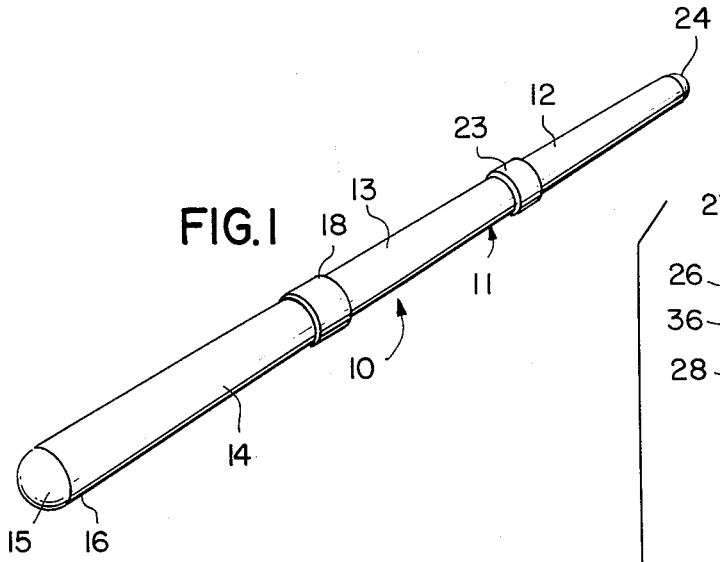
FIG. 1
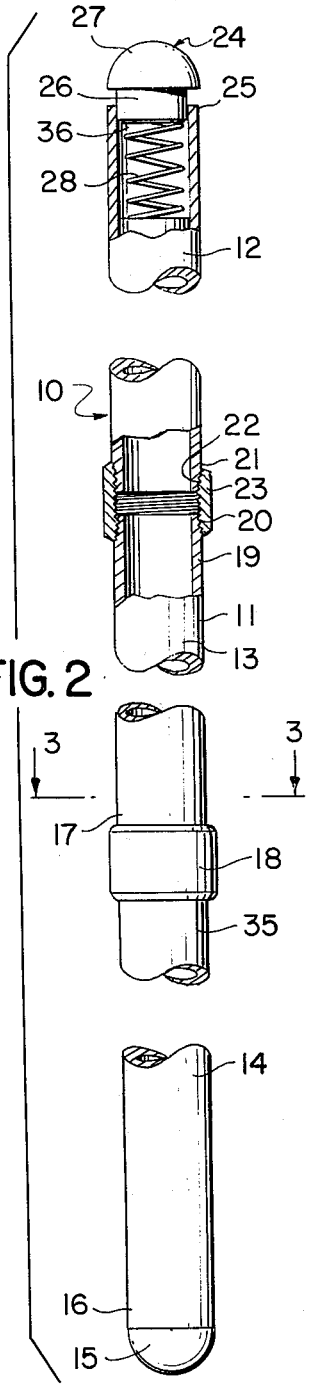
FIG. 2
FIG. 3
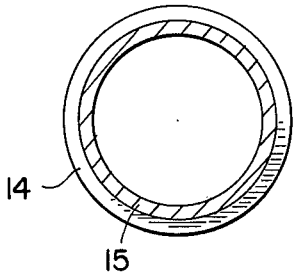
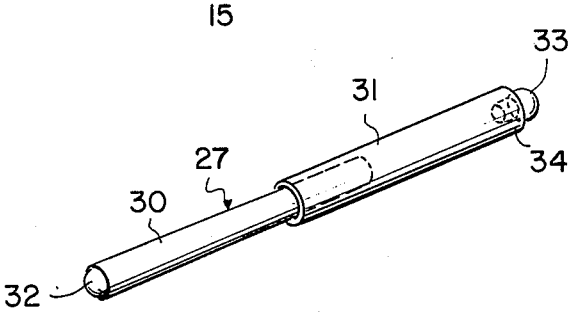
FIG. 4

IMPACT TOOL FOR INSTALLING DORMERS

SUMMARY OF THE INVENTION

Our invention relates to a unique and novel impact tool used to apply an impact blow to the underside of a portion of a roof that has been cut.

A number of U.S. Pat. Nos. 1,521,265; 2,066,427; and 2,475,041 have employed various construction tools, but these aforementioned patents are non-applicable to our present invention.

An object of our present invention is to provide an impact tool that is capable of applying an impact blow to an underside of a portion of a roof that has been cut.

A further object of our present invention is to provide a cylindrical handle member capable of length adjustment.

A still further object of our invention is to provide an impact tool of simple design and relatively low manufacturing cost.

Briefly, our present invention comprises an elongated hollow handle formed from a plurality of sections, wherein the sections permit length adjustment of the handle. A heavy weight element communicates with an upper free end of a top section and a rubber cushion element communicates with a bottom end of a bottom section.

BRIEF DESCRIPTION OF THE DRAWINGS

The objects and features of the invention may be understood with reference to the following detailed description of an illustrative embodiment of the invention, taken together with the accompanying drawings in which:

FIG. 1 illustrates a perspective view of an impact tool;

FIG. 2 illustrates a side cutaway view of the impact tool;

FIG. 3 illustrates an end view of the impact tool; and

FIG. 4 illustrates a perspective view of a second type of impact tool.

DESCRIPTION OF THE PREFERRED EMBODIMENT

Turning now descriptively to the drawings in which similar reference characters denote similar elements throughout the several views, FIGS. 1-3 show an impact tool 10 used to knock out portions of a roof that have been cut as in the construction of a dormer. The impact tool 10 can be used on any operation, wherein a positive blow must be applied to a given area such as pounding down dirt or knocking down a wall. The impact tool 10 comprises a cylindrical hollow handle member 11 formed from a top section 12, a middle section 13, and a bottom section 14. The bottom section 14 has a rubber cushion element 15 affixed onto a bottom end 16 of the section 14, wherein the upper end 35 of section 14 has a threaded outer surface (not shown). The bottom end 17 of the middle section 13 has a threaded outer surface (not shown). The bottom end 17 of the middle section 13 has a threaded outer surface (not shown), wherein the upper end 35 of section 14 is joined to the bottom end 17 of section 13 by a first union coupling member 18. The upper end 19 of section 13 has a threaded outside surface 20. The bottom end 21 of the top section 12 has a threaded external surface 22, wherein a second union coupling member 23 joins the upper end 19 of section 13 to the bottom end 21 of section 12. A heavy weighted element 24 such as lead is slidably contained within the open top end 25 of the top section 12. The element 24 consists of a cylindrical portion 26 having a semi-spherical cap portion 27 affixed thereon. Portion 26 is slidably contained within section 12. A tension spring 28 or other suitable means can be contained within section 12 and affixed to the inner end 35 of portion 26 for controlling the longitudinal movement of portion 26 within section 12. In use, the cap portion 27 is abutted against the underside of the roof. The cushion element 15 is placed in the palm of the right hand and the left hand grasps the peripheral surface of member 11. When pressure is applied by the right hand onto element 15, an impact blow is applied by cap portion 27. The top section 12 can be used alone, or the top 12 and bottom 14 sections together, on the top 12, middle 13 and bottom 14 sections together, wherein the member 11 is adjustable in length to accommodate different roofs in various types of homes.

FIG. 4 shows a second type of handle member 29 consisting of two telescopic sections 30, 31 locked in a fixed position relative to each other by a twisting motion, wherein this type of telescopic assembly is well known in the art. A cushion element 32 is affixed to a free bottom end of the lower section 30. A heavy weighted element 33 is slidably contained in the open free end 34 of the upper section 31, wherein element 33 is identical in construction to that previously defined in FIG. 2.

Hence, obvious changes may be made in the specific embodiment of the invention described herein, such modifications being within the spirit and scope of the invention claimed, it is indicated that all matter contained herein is intended as an illustrative and not as limiting in scope.

Having thus described the invention, what we claim as new and desire to secure by Letters Patent of the United States is:

1. An impact tool for knocking out portions of a roof that have been previously cut, which comprises:

a. a cylindrically shaped hollow handle member formed from a plurality of sections, each said section having a threaded outer surface at each end thereof;

b. a plurality of union coupling members, each said coupling member being internally threaded, one of said coupling members threadably joining together each of two of said sections;

c. a rubber cushion element affixed onto an open free end of one said end section of said handle member, said rubber element received into a palm of a hand;

d. a lead weight element having a cylindrically shaped portion and a semi-spherical cap portion affixed onto one end of said cylindrically shaped portion, said cylindrically shaped portion slideably disposed in an open free end of said other end section of said handle member; and e. a tension spring disposed within said open free end of said other end section, said tension spring communicating with said cylindrically shaped portion of said lead weight element and urging said lead weight element outwardly from said open free end of said other section, said lead weight element engaging said portion of said roof.

* * * * *